US005696330A

United States Patent [19]

Heinonen

[11] Patent Number: 5,696,330

[45] Date of Patent: Dec. 9, 1997

[54] PHASE PIPETTE

[75] Inventor: Mauno Heinonen, Vantaa, Finland

[73] Assignee: Labsystems, Ltd., Helsinki, Finland

[21] Appl. No.: 630,441

[22] Filed: Apr. 10, 1996

[30] Foreign Application Priority Data

Apr. 12, 1995 [FI] Finland ..... 95 1766

[51] Int. Cl.[6] ..... B01L 3/02

[52] U.S. Cl. ..... 73/864.13

[58] Field of Search ..... 73/864.13, 864.16, 73/864.18; 422/100

[56] References Cited

U.S. PATENT DOCUMENTS

| | | |
|---|---|---|
| 3,646,817 | 3/1972 | Hinchman et al. . |
| 3,834,590 | 9/1974 | Robinson et al. . |
| 3,935,734 | 2/1976 | Keegan . |
| 4,061,037 | 12/1977 | Keegan . |
| 4,284,604 | 8/1981 | Tervamaki . |
| 5,104,624 | 4/1992 | Labriola . |

FOREIGN PATENT DOCUMENTS

| | | |
|---|---|---|
| 662215 | 12/1995 | Australia . |
| 2260384 | 5/1975 | France . |
| 4039971 | 6/1992 | Germany . |
| 4104831A1 | 10/1992 | Germany . |
| 931761 | 7/1994 | Switzerland . |
| 1579886 | 11/1980 | United Kingdom . |

OTHER PUBLICATIONS

European Search Report No. 96660008.2 dated May 8, 1996.

*Primary Examiner*—Robert Raevis

[57] ABSTRACT

The invention relates to a pipette used for dosing of liquids. The most characteristic feature of the pipette is that in order to remove the liquid as completely as possible, the dosing piston (18) is pressed first into a low position below the basic position, after which an additional removing phase is carried out using a separate removing piston (13), so that the piston area that affects the liquid container (3) is greater during the additional removing phase. This way, a pressure stroke is formed, which effectively and reliably removes even the droplet that easily remains at the tip of the container. Most preferably, both the removing piston and the dosing piston move in the additional removing phase.

12 Claims, 4 Drawing Sheets

PHASE PIPETTE

TECHNICAL FIELD

This invention relates to piston-operated pipettes, which are used for handling liquids. Specifically, the invention relates to the complete removal of liquid from the pipette. The invention is especially suitable for pipettes which should enable exact dosing of relatively little amounts of liquid, such as in the order of one microliter.

BACKGROUND OF THE INVENTION

Piston-operated pipettes usually have a function called secondary movement, due to which the movement of the piston is longer when the liquid is ejected than the movement of the piston when the liquid is drawn in. This improves the complete ejection of the liquid from the pipette as much as possible. In known hand-operated pipettes, the secondary movement is arranged using two springs, whereas in electrically operated pipettes, the secondary movement can be produced by a suitable arrangement controlling the motor. It is characteristic of both the prior art approaches, that both the primary movement and the secondary movement are carried out by the same piston.

Patent specification U.S. Pat. No. 3,646,817 proposes a pipette having two spring-operated pistons, one of which is inside the other. The inner piston is a dosing piston the stroke of which determines the volume of the dose. The stroke of the dosing piston when drawing the liquid in is of the same length as when ejecting the liquid. The outer piston is a secondary piston which does not begin to move before the dosing piston has completed its downward stroke.

DESCRIPTION OF THE INVENTION

General description

A pipette according to claim 1 has now been invented. Some of its preferred embodiments are presented in the other claims.

The most characteristic feature of the pipette is that to remove the liquid as completely as possible, the dosing piston is first pressed into a low position below the basic position, after which an additional removing phase is performed using a separate removing piston, so that the piston area affecting the liquid container is greater in the additional removing phase, which effects the formation of more pressure in the container. This way, a pressure stroke that effectively and reliably removes even the droplet that tends to stay at the tip of the container is directed to the container. Most preferably, the removing piston and the dosing piston both move during the additional removing phase.

The pipette can either be a hand-operated pipette or a motor-operated pipette.

BRIEF DESCRIPTION OF DRAWING

In the accompanying drawing.

DETAILED DESCRIPTION

Figure 1:
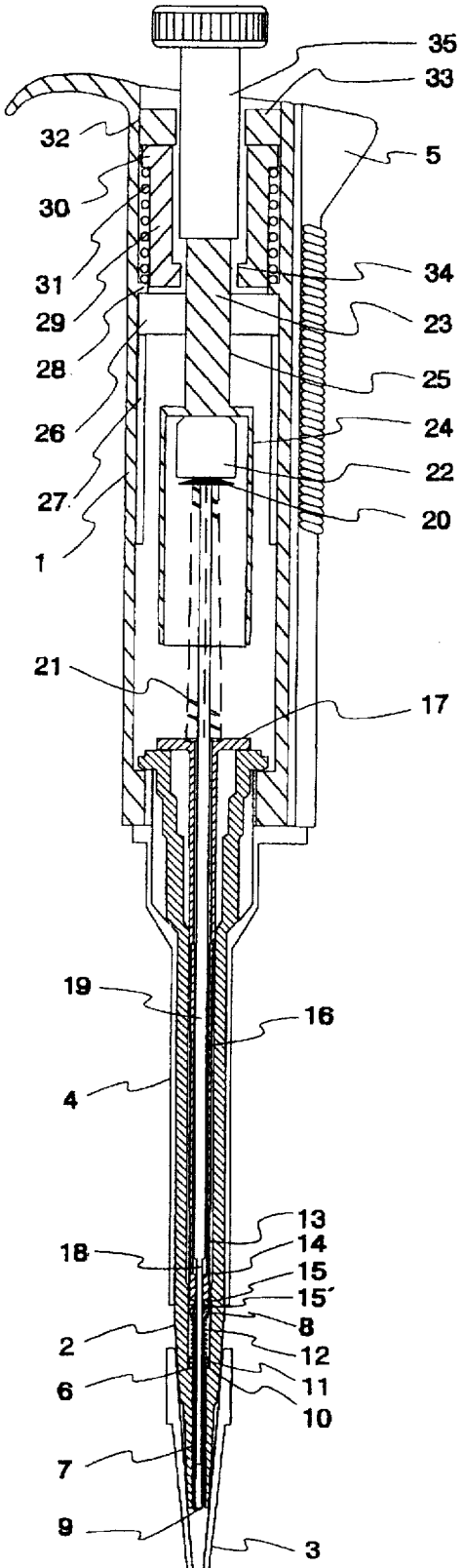
FIG. 1 shows a first pipette embodiment of the invention.
Figure 2:
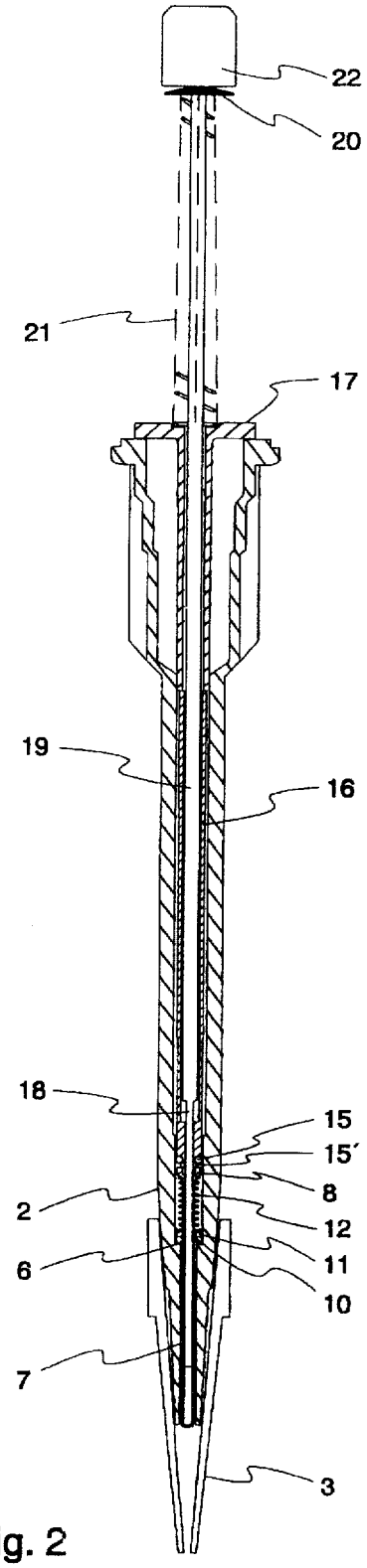
FIG. 2 is an enlarged view of the distal part of the pipette of FIG. 1.

The casing of the pipette of FIGS. 1–3 is composed of a handle part 1 and at its low end a narrower distal part 2, on which there is positioned a distal container 3. On the distal part 2 there is a slidable sleeve 4 for removing the distal container 3, and as an extension of the sleeve 4, on the side of the handle part 1, there is an arm 5 for operating the sleeve. The device for removing the distal container 3 can, for example, be such as described in specification FI-C-92374.

There is a bore through the distal part 2. The lower part of the bore comprises a narrower tip bore and the upper part comprises a wider shaft bore. At their point of contact, there is a threshold 6 (see FIG. 3*a*). Fitted into the tip bore there is a sleeve-like dosing cylinder 7, which is longer than the tip bore. In the upper end of the cylinder, there is a flange 8. The hole in the lower end 9 of the cylinder is smaller than the inner diameter of the cylinder 7. As will be explained hereinafter (in conjunction with FIG. 3*d*) the sleeve-like dosing cylinder also functions as a "removing" piston.

The outer surface of the cylinder 7 is sealed against the distal part 2. For this, there is an O-ring 10 in the shaft bore (see FIG. 3*c*). Around the cylinder, there are a support ring 11 and a cylinder spring 12, so that the spring, via the ring, presses the O-ring against the threshold 6.

Above the cylinder 7 there is fitted a tubelike cylinder shaft 13. It comprises a lower part corresponding to the inner diameter of the cylinder 7 and a broader upper part, there being a threshold 14 between them. The cylinder shaft is sealed against the distal part 2 using an O-ring 15, which is fitted into the lower part of the shaft.

As an extension of the cylinder shaft 13, above it, there is a shaft sleeve 16. In the upper end of the shaft sleeve, there is a flange 17 (see FIGS. 1 and 2) resting on the upper flange of the distal part 2.

Inside the cylinder 7 there is a dosing piston 18 fitted tightly. As a fixed extension of the piston 18, there is a broader shaft 19. Surrounding the piston rod, between the fastening ring 20 (see FIG. 1) and the flange 17 of the shaft sleeve 16 of the cylinder shaft there is a primary spring 21 pushing the piston 18 towards its upper position and holding the flange 17 against the distal part 2. In the upper end of the piston rod there is a counter button 22.

The piston 18 is sealed by an O-ring 15' between the O-ring 15 and the upper flange 8 of the cylinder 7, by the force of the cylinder spring 12.

Above the piston rod 19 as seen in FIG. 1 there is a button shaft 23. At its lower end there is a sleeve 24 surrounding the piston rod. There is an adjusting ring 26 fitted around the button shaft using the thread 25. The adjusting ring is fitted in the handle part 1 in such a way that it is vertically slidable, without screwing, along guides 27. Above the adjusting ring, in the casing, there is a stopper 28 and a calibrating sleeve 29. At the upper end of the sleeve 29, there is a protruding flange 30. Between the flange and the stopper 26, there is fitted a secondary spring 31, which pushes the calibrating sleeve 29 upwards. The upper position of the sleeve 29 is determined by a nut 33 fitted into the casing by thread 32. Inside the lower end of the sleeve 29 there is a lower flange 34.

At the upper end of the button shaft 23 there is a button 35, which is broader than the shaft and extends above the casing.

When the pipette is unstrained, the piston 18 being in the initial position, the primary spring 21 pushes both the piston 18 against the button shaft 23, and the adjusting ring 26 against the stopper 28. The secondary spring 31 pushes the calibrating sleeve 29 against the nut 33. When the button 35 is pressed, the piston 18 moves downwards against the force of the primary spring 21. As the lower end of the button meets the lower flange 34 of the calibrating sleeve 29, the secondary spring 31 also begins to resist the movement of the button 35, whereupon a clear increase of resistance is felt. The piston 18 is held in this position whilst the tip 3 of the distal container is placed into the liquid to be pipetted. The piston is then released to return to its upper position, whereupon it draws a certain amount of liquid into the container.

The length of the primary movement, and thus also the volume of the incoming liquid, can be adjusted by turning the button 35.

Figure 3A:
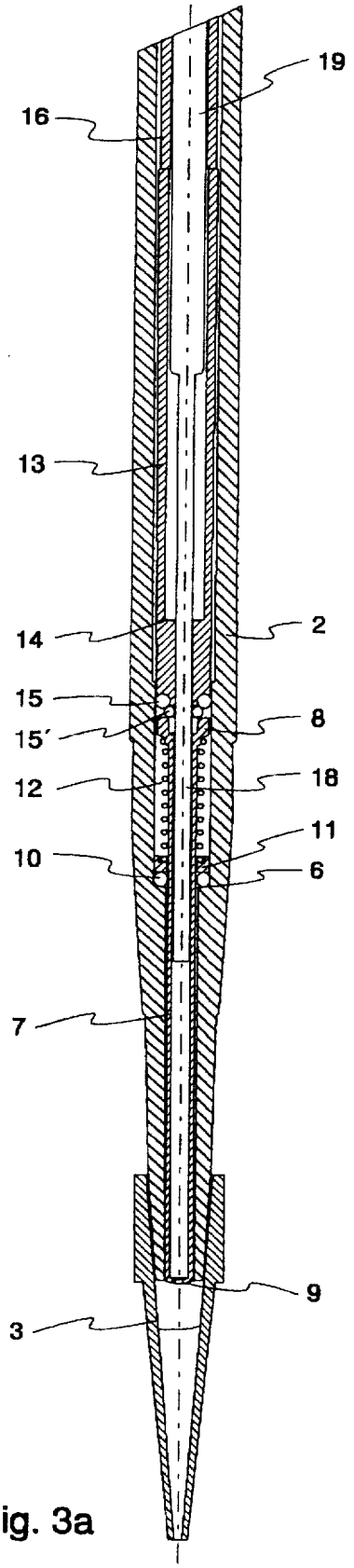
FIGS. 3*a*–3*d* are enlarged views of the lower part of the distal part of FIG. 2 in different phases of operation.
Figure 3B:
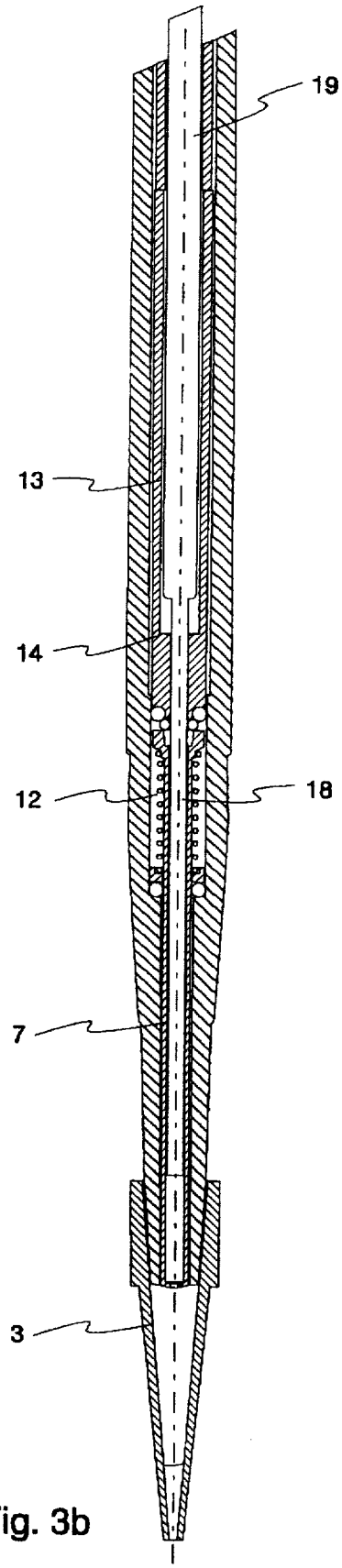
Figure 3C:
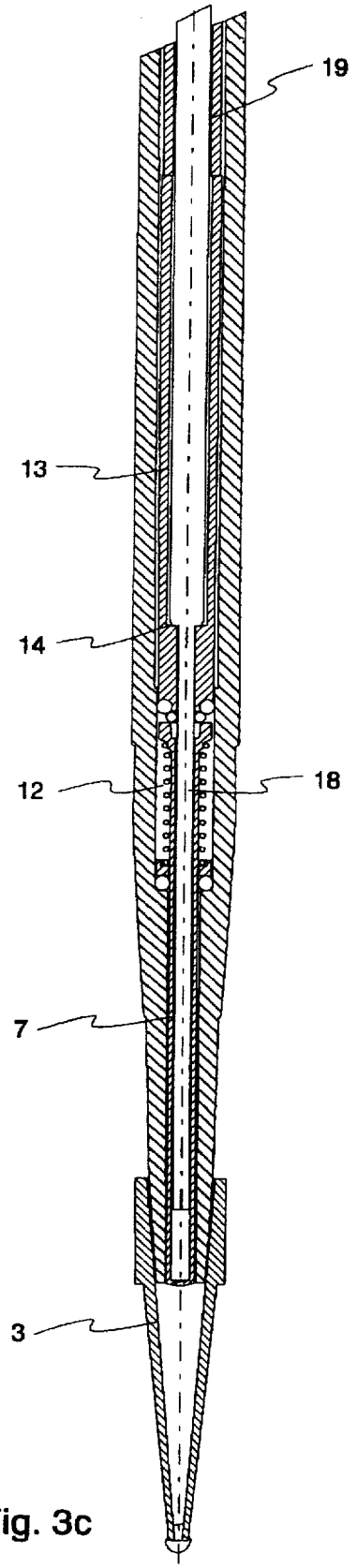
Figure 3D:
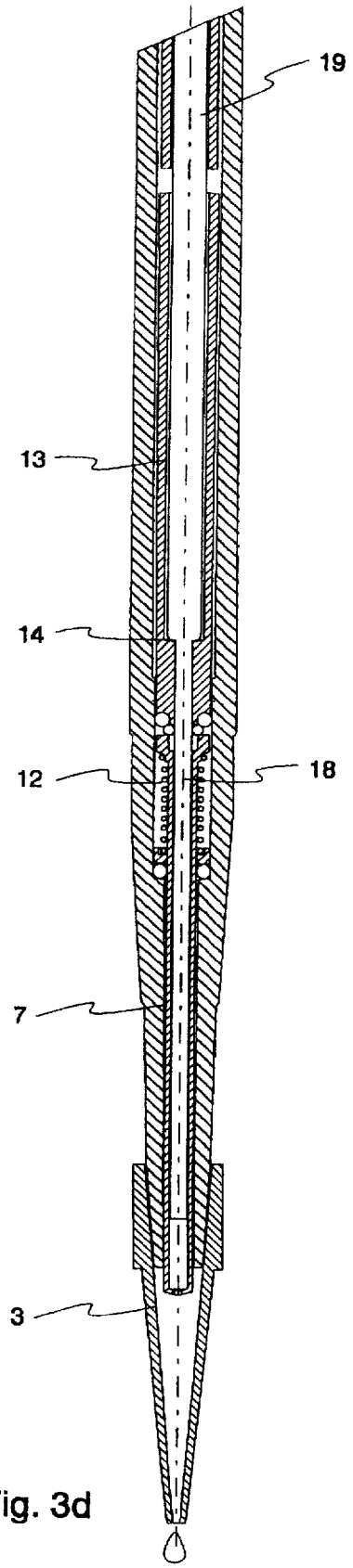

When the liquid that was drawn in is to be removed, the button 35 is pressed downwards. In the primary phase (FIG. 3*a*), the piston 18 moves downwards the same length as when drawing the liquid in. Therefore, at the end of the primary phase, the lower end of the button is positioned in such a way that it touches the lower flange 34 of the calibrating sleeve 29. After that, as the pressing of the button is continued, the secondary spring 31 also resists the movement. The parts of the pipette are designed such that at the beginning of the secondary movement, the lower end of the piston rod 19 is above the threshold 14 of the cylinder shaft 13 (FIG. 3*b*). At the first stage of the secondary phase, the piston 18 moves downwards, until the lower end of the piston rod 19 meets the threshold 14 of the cylinder shaft (FIG. 3*c*). As the pressing of the button is continued to be pressed, the cylinder shaft 13 and the cylinder 7 also start moving against the force of the cylinder spring 12 (FIG. 3*d*). The cylinder 7 is larger in diameter than the piston 18, and the additional pressure stroke that it directs to the distal container 3 removes even the droplet remaining at the tip of the container see the bottom part of FIG. 3*d*. Here the cylinder 7 serves as a "removing" piston.

A pipette usually includes some kind of a volume display system, such as the one described in specification FI-64752 (corresponds to, e.g., specification U.S. Pat. No. 4,554,134).

Figure 4:
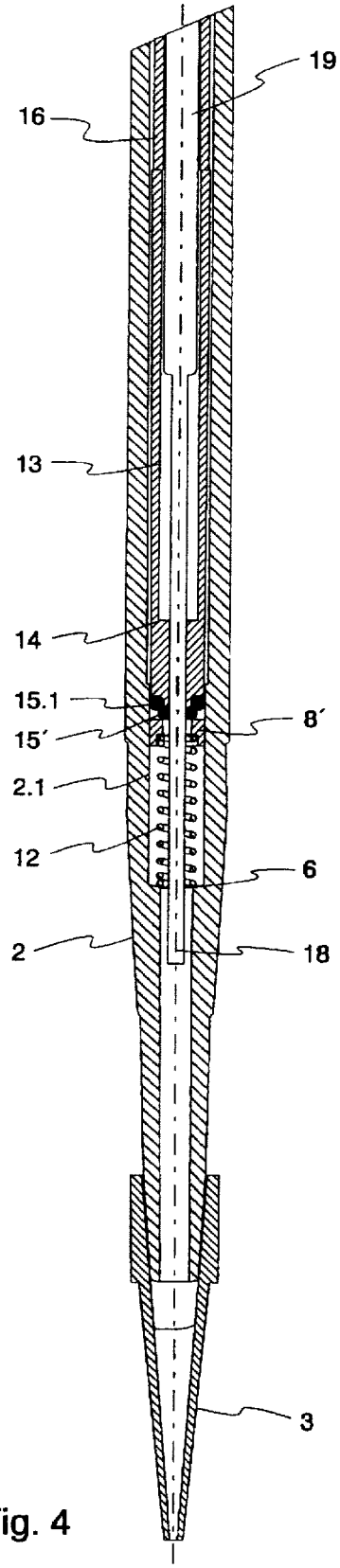
FIG. 4 shows the lower part of the distal part of a second pipette embodiment according to the invention.

In the pipette of FIG. 4, the distal part 2 functions as a dosing cylinder without having a separate cylinder piece i.e., the sleeve-like cylinder 7. The broader upper part 2.1 of the tip functions as a removing cylinder. The upper end of the spring 12 pushes the support ring 8' against the O-rings 15' and 15.1. By this means, the piston 18 is sealed in relation to the end part.

I claim:

1. A phase pipette, comprising an oblong casing with an upper end and a lower end, a container for liquid mounted on the lower end of said casing, a dosing cylinder in said casing, a movable dosing piston slidably mounted in said dosing cylinder, said dosing piston having a basic position and above said basic position an up position and below said basic position a low position, so that as said dosing piston moves from its said basic position towards its said up position, suction is created in the container, and as said dosing piston moves from its said up position towards its said low position, pressure is created in the container, a removing means for creating more pressure in the container than when said dosing piston moves from its said basic position towards its said low position, means for moving the dosing piston, said creating means only being actuatable after said dosing piston has been moved from its said basic position to its said low position, said casing including a primary spring which pushes said dosing piston from its said basic position towards its said up position, and said casing including a secondary spring which pushes said dosing piston from its said low position towards its said basic position.

2. A pipette of claim 1 in which the creating means surrounds the dosing piston.

3. A pipette of claim 2 in which the creating means is the cylinder of the dosing piston.

4. A pipette of claim 1 in which said creating means includes means for moving said dosing piston below its said low position to a lower additional removing piston to provide additional pressure in said container.

5. A pipette of claim 1 wherein said casing includes an additional secondary spring which pushes said dosing piston from a position lower than said low position towards its said basic position.

6. A pipette of claim 5 in which said casing includes O-ring means operably associated with said creating means, said additional secondary spring pressing said O-ring means to seal said creating means.

7. A pipette of claim 1 in which said creating means surrounds said dosing piston, said dosing piston including a first rod part of a predetermined size and said dosing piston also including a second rod part which is narrower and lower than said first rod part.

8. A pipette of claim 1 in which said casing includes spring means which pushes said dosing piston from its said low position towards its said basic position.

9. A pipette of claim 1 in which said creating means includes means for moving said dosing piston below its said low position to a lower additional removing position to provide additional pressure in said container, said casing including spring means which pushes said dosing piston form a position lower than said low position towards its said basic position.

10. A phase pipette, comprising an oblong casing with an upper end and a lower end, a container for liquid mounted on the lower end of said casing, a dosing cylinder in said casing, a movable dosing piston slidably mounted in said dosing cylinder, said dosing piston having a basic position add above said basic position an up position and below said basic position a low position, so that as said dosing piston moves from its said basic position towards its said up position, suction is created in the container, and as said dosing piston moves from its said up position towards its said low position, pressure is created in the container, a removing means for creating more pressure in the container than when said dosing piston moves from its said basic position towards its said low position, means for moving the dosing piston, said creating means only being actuatable after said dosing piston has been moved from its said basic position to its said low position, said casing including a primary spring which pushes said dosing piston from its said basic position towards it said up position, said casing including a secondary spring which pushes said dosing piston from its said low position towards its said basic position, said casing including an additional secondary spring which pushes said dosing piston from a position lower than said low position towards its said basic position, said creating means including a sleeve piston around said dosing piston and said sleeve piston serving as said dosing cylinder, said casing including an O-ring operably associated with said creating means, and said additional secondary spring pressing said O-ring to seal said dosing piston against said dosing cylinder.

11. A phase pipette comprising an oblong casing with an upper end and a lower end, a container for liquid mounted on the lower end of said casing, a dosing cylinder in said casing, a movable dosing piston slidably mounted in said dosing cylinder, said dosing piston having a basic position and above said basic position an up position and below said basic position a low position, so that as said dosing piston moves from its said basic position towards its said up position, suction is created in said container, and as said dosing piston moves from its up position towards its said low position, pressure is created in the container, said casing including a removing cylinder in which is mounted said dosing cylinder and which serves as a movable removing piston, said removing piston having a first position and a second position so that as said removing piston moves from its said first position towards its said second position more pressure is created in said container than when said dosing piston moves from its said basic position towards its said low position, means operably associated with said casing for moving said dosing piston and for moving the removing piston, the removing piston not being movable from its said first position until said dosing piston has been moved from its said basic position to its said low position, said casing including a primary spring which pushes said dosing piston from its said basic position towards it said up position, said casing including a secondary spring which pushes said dosing piston from its said low position toward its said basic position.

12. A pipette of claim 11 wherein said casing includes an additional secondary spring which pushes said removing piston from its said second position towards its said first position.

* * * * *

UNITED STATES PATENT AND TRADEMARK OFFICE

CERTIFICATE OF CORRECTION

PATENT NO. : 5,696,330

DATED : December 9, 1997

INVENTOR(S) : Mauno Heinonen

It is certified that error appears in the above-indentified patent and that said Letters Patent is hereby corrected as shown below:

In Claim 10, column 4, line 37, delete "add" and substitute therefor -- and --.

Signed and Sealed this

Tenth Day of March, 1998

Bruce Lehman

*Attest:*

BRUCE LEHMAN

*Attesting Officer*

*Commissioner of Patents and Trademarks*